US010555613B1

(12) United States Patent
Harris

(10) Patent No.: US 10,555,613 B1
(45) Date of Patent: Feb. 11, 2020

(54) REMOTE CONTROL FOOTREST

(71) Applicant: Samuel Harris, Dallas, TX (US)

(72) Inventor: Samuel Harris, Dallas, TX (US)

( * ) Notice: Subject to any disclaimer, the term of this patent is extended or adjusted under 35 U.S.C. 154(b) by 0 days.

(21) Appl. No.: 16/181,908

(22) Filed: Nov. 6, 2018

(51) Int. Cl.
*A47C 16/02* (2006.01)
*A47C 31/00* (2006.01)

(52) U.S. Cl.
CPC ..... *A47C 16/025* (2013.01); *A47C 31/008* (2013.01)

(58) Field of Classification Search
CPC ..... A47C 16/02; A47C 16/025; A47C 31/008; A47C 7/50; A47C 7/506; A47C 7/5064
See application file for complete search history.

(56) References Cited

U.S. PATENT DOCUMENTS 2,248,369 A * 7/1941 Ludersen ..... A47C 16/025 248/371
2,473,947 A 6/1949 Hamstrom
4,232,901 A * 11/1980 Harrington ..... A47C 16/025 108/147
6,394,528 B2 5/2002 Hoenack
6,474,724 B2 11/2002 Lemmon
6,631,524 B1 10/2003 Dixon
7,303,637 B2 12/2007 Farrar
D596,417 S 7/2009 Bowen
7,669,934 B1 3/2010 Cline
8,239,988 B2 * 8/2012 Brenner ..... A47C 16/025 5/648
8,757,580 B2 * 6/2014 Volke ..... A47C 16/025 242/375.3
9,010,867 B2 * 4/2015 Martin ..... A47C 3/029 297/271.5
9,241,574 B2 * 1/2016 Koch ..... A47C 31/008
9,414,979 B2 * 8/2016 Davis ..... A61G 7/0755
9,585,489 B1 * 3/2017 Al-Quraini ..... A47C 16/025
2006/0272893 A1 * 12/2006 Foggio ..... A47C 16/025 182/69.1
2018/0042386 A1 * 2/2018 Hall ..... G01G 19/50

* cited by examiner

*Primary Examiner* — Philip F Gabler

(57) ABSTRACT

A remote control footrest for elevating an injured foot includes a base having a top side, a bottom side, a front side, a back side, a right side, a left side, and a cavity. The top side has a pole aperture extending through to the cavity. A lift means is coupled to the base within the cavity. An adjustable support pole is coupled to the base through the pole aperture and is in operational communication with the lift means. The lift means adjusts a length of the adjustable support pole. A footrest is coupled to the adjustable support pole and is configured to support a foot or a leg of a user. A remote control is in wireless communication with the lift means to adjust the length of the adjustable support pole and thus a height of the footrest.

9 Claims, 4 Drawing Sheets

REMOTE CONTROL FOOTREST

CROSS-REFERENCE TO RELATED APPLICATIONS

Not Applicable

STATEMENT REGARDING FEDERALLY SPONSORED RESEARCH OR DEVELOPMENT

Not Applicable

THE NAMES OF THE PARTIES TO A JOINT RESEARCH AGREEMENT

Not Applicable

INCORPORATION-BY-REFERENCE OF MATERIAL SUBMITTED ON A COMPACT DISC OR AS A TEXT FILE VIA THE OFFICE ELECTRONIC FILING SYSTEM

Not Applicable

STATEMENT REGARDING PRIOR DISCLOSURES BY THE INVENTOR OR JOINT INVENTOR

Not Applicable

BACKGROUND OF THE INVENTION (1) Field of the Invention.

(2) Description of Related Art including information disclosed under 37 CFR 1.97 and 1.98

The disclosure and prior art relates to footrests and more particularly pertains to a new footrest for elevating an injured foot.

BRIEF SUMMARY OF THE INVENTION

An embodiment of the disclosure meets the needs presented above by generally comprising a base having a top side, a bottom side, a front side, a back side, a right side, a left side, and a cavity between the top side, the bottom side, the front side, the back side, the right side, and the left side. The top side has a pole aperture extending through to the cavity. A lift means is coupled to the base within the cavity. An adjustable support pole is coupled to the base through the pole aperture and is in operational communication with the lift means. The lift means adjusts a length of the adjustable support pole. A footrest is coupled to the adjustable support pole and is configured to support a foot or a leg of a user. A remote control is in wireless communication with the lift means to adjust the length of the adjustable support pole and thus a height of the footrest.

There has thus been outlined, rather broadly, the more important features of the disclosure in order that the detailed description thereof that follows may be better understood, and in order that the present contribution to the art may be better appreciated. There are additional features of the disclosure that will be described hereinafter and which will form the subject matter of the claims appended hereto.

The objects of the disclosure, along with the various features of novelty which characterize the disclosure, are pointed out with particularity in the claims annexed to and forming a part of this disclosure.

BRIEF DESCRIPTION OF SEVERAL VIEWS OF THE DRAWING(S)

The disclosure will be better understood and objects other than those set forth above will become apparent when consideration is given to the following detailed description thereof. Such description makes reference to the annexed drawings wherein.

DETAILED DESCRIPTION OF THE INVENTION

Figure 1:
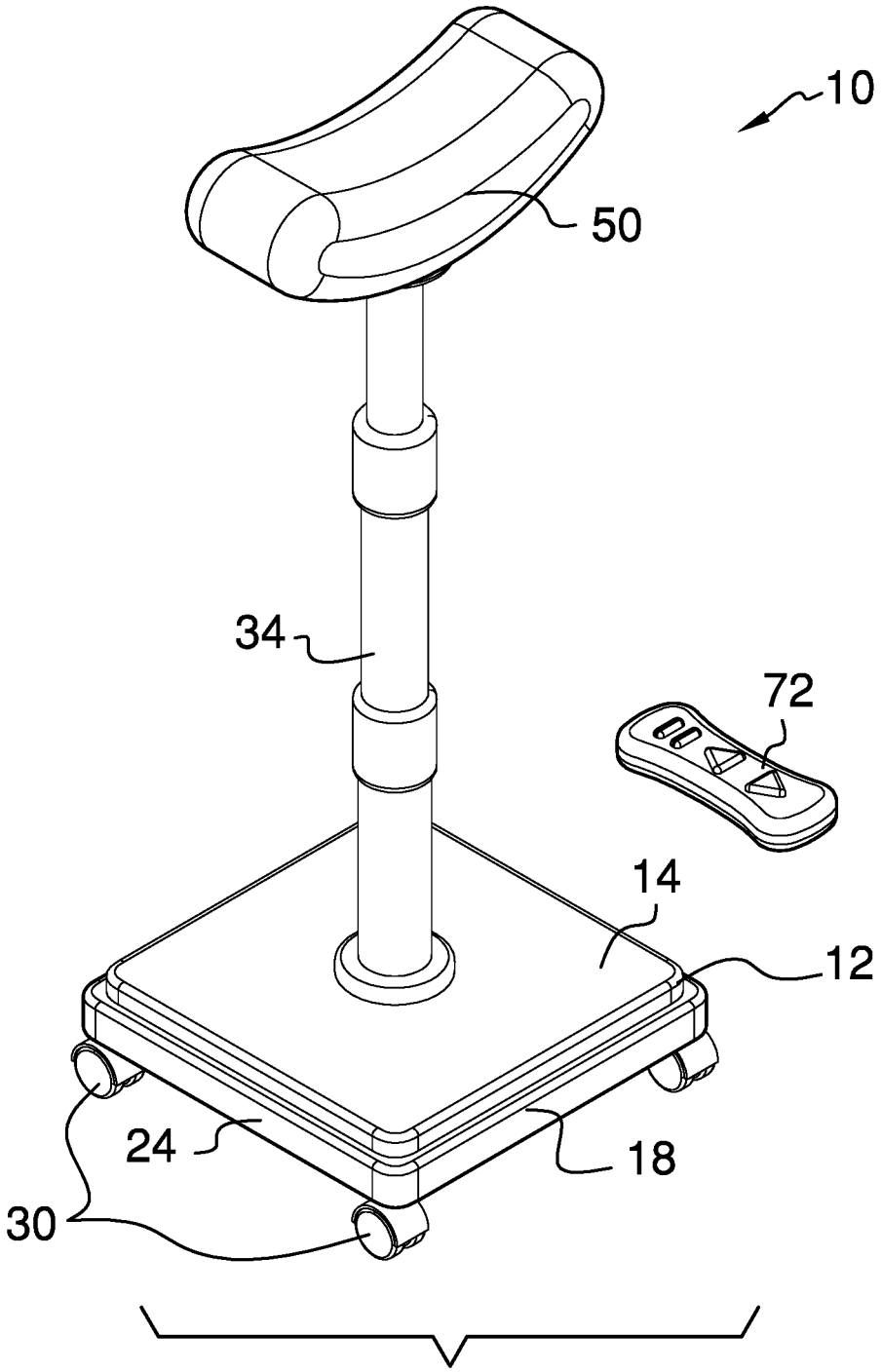
FIG. 1 is an isometric view of a remote control footrest according to an embodiment of the disclosure.
Figure 2:
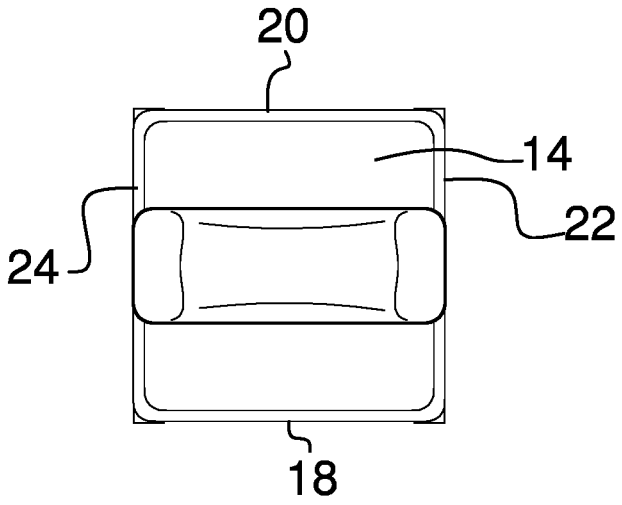
FIG. 2 is a top plan view of an embodiment of the disclosure.
Figure 3:
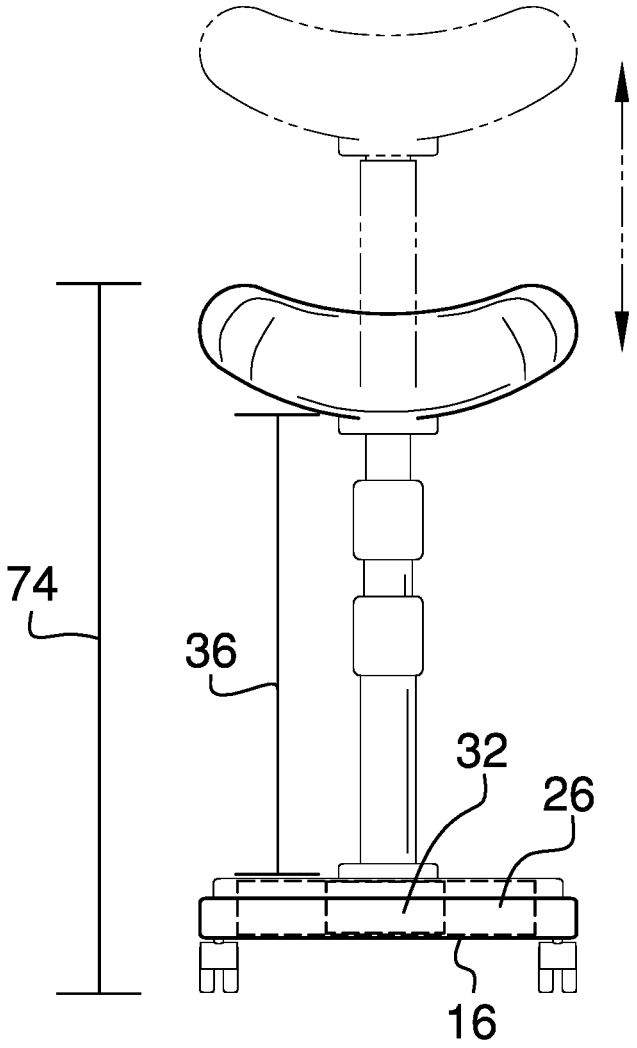
FIG. 3 is a front elevation view of an embodiment of the disclosure.
Figure 4:
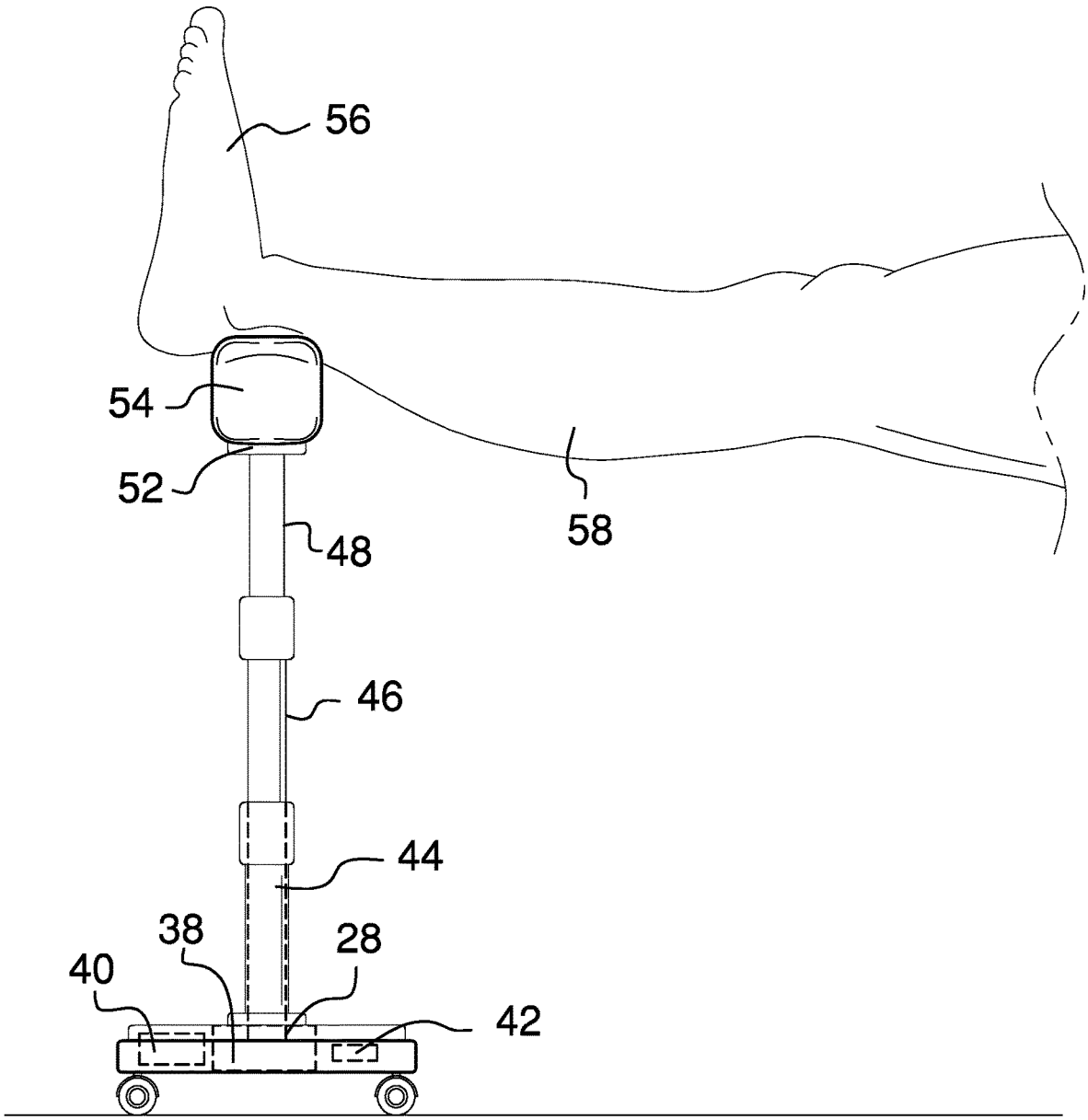
FIG. 4 is an in-use view of an embodiment of the disclosure.
Figure 5:
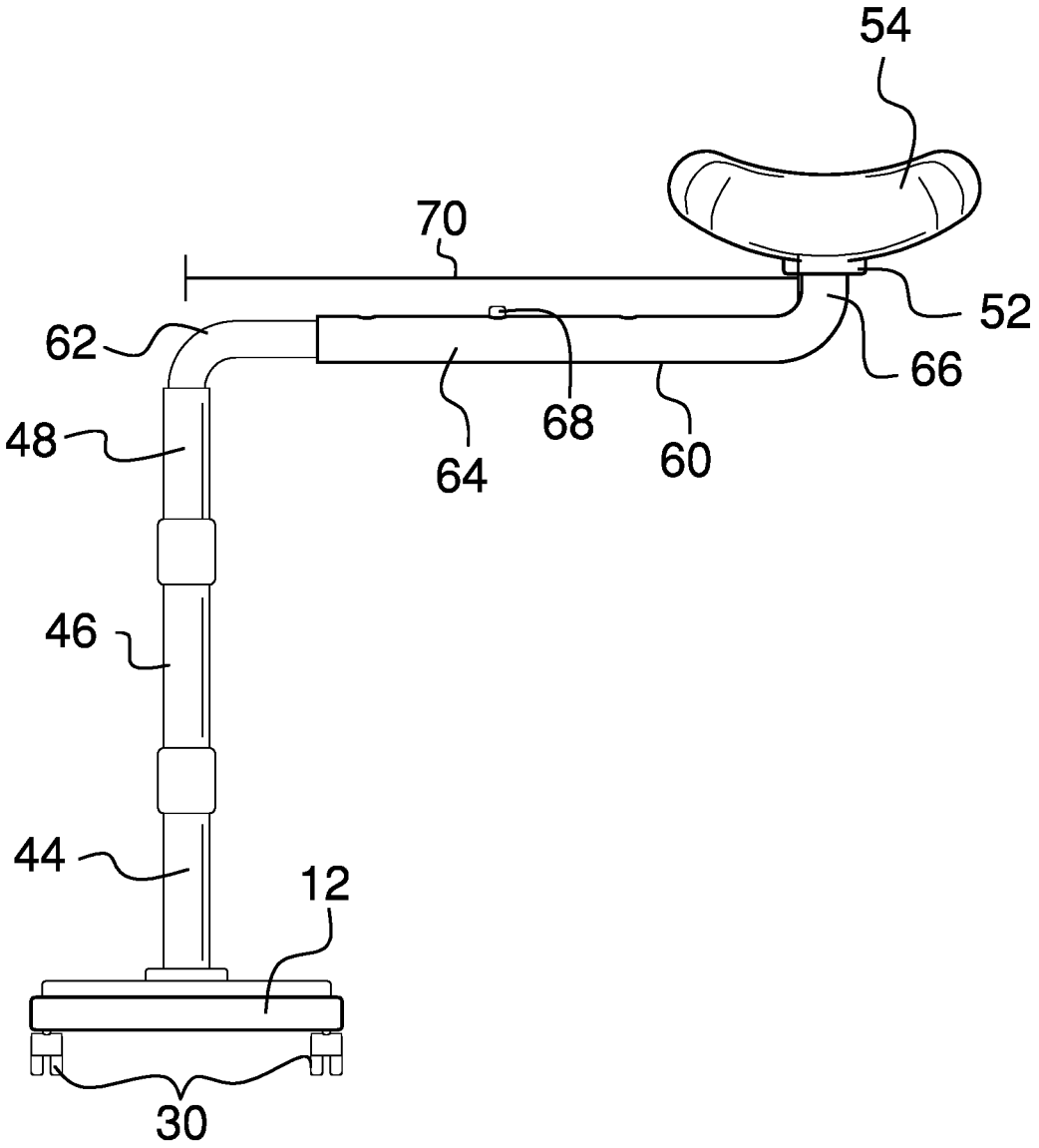
FIG. 5 is a front view of an embodiment of the disclosure.

With reference now to the drawings, and in particular to FIGS. 1 through 5 thereof, a new footrest embodying the principles and concepts of an embodiment of the disclosure and generally designated by the reference numeral 10 will be described.

As best illustrated in FIGS. 1 through 5, the remote control footrest 10 generally comprises a base 12 having a top side 14, a bottom side 16, a front side 18, a back side 20, a right side 22, a left side 24, and a cavity 26 between the top side 14, the bottom side 16, the front side 18, the back side 20, the right side 22, and the left side 24. The top side 14 has a pole aperture 28 extending through to the cavity 26. A plurality of wheels 30 may be coupled to the bottom side 16 of the base. A lift means 32 is coupled to the base 12 within the cavity 26. An adjustable support pole 34 is coupled to the base 12 through the pole aperture 28 and is in operational communication with the lift means 32. The lift means 32 adjusts a length 36 of the adjustable support pole.

The lift means 32 may comprise a lift mechanism 38, a power supply 40, and a receiver 42 each coupled within the cavity 26 of the base. The lift mechanism 38 is coupled below the pole aperture 28 and is in operational communication with the adjustable support pole 34. The power supply 40 is in operational communication with, and provides power to, the lift mechanism 38. The receiver 42 is in operational communication with the lift mechanism 38.

The adjustable support pole 34 may comprise a lower section 44, a middle section 46, and an upper section 48. The lower section 44, the middle section 46, and the upper section 48 are telescopable to change the length 36. The lower section is coupled through the pole aperture 28 of the base. A footrest 50 is coupled to the adjustable support pole 34. The footrest 50 has a pole receptacle 52 and a pad 54. The pole receptacle 52 is coupled to the upper section 48 and the pad 54 is coupled to the pole receptacle 52. The pad 54 may be curved and is configured to support a foot 56 or a leg 58 of a user. A horizontal extension 60 may be coupled to the adjustable support pole 34. The horizontal section 60 has a bent proximal end 62, an arm 64, and a bent distal end 66. The footrest 50 is coupled to the bent distal end 66 of the horizontal extension and the bent proximal end 62 is coupled to the upper section 48 of the adjustable support pole. The arm 64 may have an adjustment mechanism 68 to adjust a horizontal length 70 of the horizontal extension. The horizontal section 60 and the adjustment mechanism 68 and be used to appropriately position the footrest 50 if an obstacle prevents the base 12 from being directly beneath the desired position.

A remote control 72 is in wireless communication with the receiver 42 to control the lift mechanism 38. The remote control 72 adjusts the length 36 of the adjustable support pole and thus a height 74 of the footrest from the ground.

In use, the user adjusts the height 74 of the footrest with the remote control 72 to elevate her injured foot 56 or leg 58. Depending on the height of the chair, sofa, or bed on which she rests, the user will require a different height 74, yet they may also want to increase or decrease the elevation and thus the height 74 for different intervals of time. The remote control 72 allows her to do so without getting up.

With respect to the above description then, it is to be realized that the optimum dimensional relationships for the parts of an embodiment enabled by the disclosure, to include variations in size, materials, shape, form, function and manner of operation, assembly and use, are deemed readily apparent and obvious to one skilled in the art, and all equivalent relationships to those illustrated in the drawings and described in the specification are intended to be encompassed by an embodiment of the disclosure.

Therefore, the foregoing is considered as illustrative only of the principles of the disclosure. Further, since numerous modifications and changes will readily occur to those skilled in the art, it is not desired to limit the disclosure to the exact construction and operation shown and described, and accordingly, all suitable modifications and equivalents may be resorted to, falling within the scope of the disclosure. In this patent document, the word "comprising" is used in its non-limiting sense to mean that items following the word are included, but items not specifically mentioned are not excluded. A reference to an element by the indefinite article "a" does not exclude the possibility that more than one of the element is present, unless the context clearly requires that there be only one of the elements.

I claim:

1. A remote control footrest comprising:

a base, the base having a top side, a bottom side, a front side, a back side, a right side, a left side, and a cavity between the top side, the bottom side, the front side, the back side, the right side, and the left side, the top side having a pole aperture extending through to the cavity;

a lift means coupled to the base, the lift means being coupled within the cavity;

an adjustable support pole coupled to the base, the adjustable support pole being coupled through the pole aperture and in operational communication with the lift means, the lift means adjusting a length of the adjustable support pole;

a footrest coupled to the adjustable support pole, the footrest being configured to support a foot or a leg of a user; and a remote control, the remote control being in wireless communication with the lift means, the remote control adjusting the length of the adjustable support pole and thus a height of the footrest.

2. The remote control footrest of claim 1 further comprising the lift means comprising:

a lift mechanism coupled to the housing, the lift mechanism being coupled within the cavity below the pole aperture, the lift mechanism being in operational communication with the adjustable support pole;

a power supply coupled to the housing, the power supply being coupled within the cavity, the power supply being in operational communication with, and providing power to, the lift mechanism; and a receiver coupled to the housing, the receiver being coupled within the cavity, the receiver being in operational communication with the lift mechanism and the remote control.

3. The remote control footrest of claim 2 further comprising the adjustable support pole having a lower section, a middle section, and an upper section, the lower section, the middle section, and the upper section being telescopable, the lower section being coupled to the base, the footrest being coupled to the upper section.

4. The remote control footrest of claim 3 further comprising a horizontal extension coupled to the adjustable support pole, the horizontal section having a bent proximal end, an arm, and a bent distal end, the bent proximal end being coupled to the upper section of the adjustable support pole, the bent distal end being coupled to the footrest.

5. The remote control footrest of claim 4 further comprising the arm having an adjustment mechanism, the adjustment mechanism adjusting a horizontal length of the horizontal extension.

6. The remote control footrest of claim 2 further comprising the footrest having a pole receptacle and a pad, the pole receptacle being coupled to the adjustable support pole and the pad being coupled to the pole receptacle, the pad being curved.

7. The remote control footrest of claim 2 further comprising a plurality of wheels coupled to the base, the plurality of wheels being coupled to the bottom side of the base.

8. A remote control footrest comprising:

a base, the base having a top side, a bottom side, a front side, a back side, a right side, a left side, and a cavity between the top side, the bottom side, the front side, the back side, the right side, and the left side, the top side having a pole aperture extending through to the cavity;

a plurality of wheels coupled to the base, the plurality of wheels being coupled to the bottom side of the base;

a lift mechanism coupled to the housing, the lift mechanism being coupled within the cavity below the pole aperture;

a power supply coupled to the housing, the power supply being coupled within the cavity, the power supply being in operational communication with, and providing power to, the lift mechanism;

a receiver coupled to the housing, the receiver being coupled within the cavity, the receiver being in operational communication with the lift mechanism;

an adjustable support pole coupled to the base, the adjustable support pole having a lower section, a middle section, and an upper section, the lower section, the middle section, and the upper section being telescopable, the lower section being coupled through the pole aperture of the base, the adjustable support pole being in operational communication with the lift mechanism;

a footrest coupled to the adjustable support pole, the footrest having a pole receptacle and a pad, the pole receptacle being coupled to the upper section of the adjustable support pole and the pad being coupled to the pole receptacle, the pad being curved, the footrest being configured to support a foot or a leg of a user; and a remote control, the remote control being in wireless communication with the receiver to control the lift mechanism, the remote control adjusting the length of the adjustable support pole and thus a height of the footrest.

9. A remote control footrest comprising:

a base, the base having a top side, a bottom side, a front side, a back side, a right side, a left side, and a cavity between the top side, the bottom side, the front side, the back side, the right side, and the left side, the top side having a pole aperture extending through to the cavity;

a plurality of wheels coupled to the base, the plurality of wheels being coupled to the bottom side of the base;

a lift mechanism coupled to the housing, the lift mechanism being coupled within the cavity below the pole aperture;

a power supply coupled to the housing, the power supply being coupled within the cavity, the power supply being in operational communication with, and providing power to, the lift mechanism;

a receiver coupled to the housing, the receiver being coupled within the cavity, the receiver being in operational communication with the lift mechanism;

an adjustable support pole coupled to the base, the adjustable support pole having a lower section, a middle section, and an upper section, the lower section, the middle section, and the upper section being telescopable, the lower section being coupled through the pole aperture of the base, the adjustable support pole being in operational communication with the lift mechanism;

a horizontal extension coupled to the adjustable support pole, the horizontal section having a bent proximal end, an arm, and a bent distal end, the bent proximal end being coupled to the upper section of the adjustable support pole, the arm having an adjustment mechanism, the adjustment mechanism adjusting a horizontal length of the horizontal extension;

a footrest coupled to the adjustable support pole, the footrest having a pole receptacle and a pad, the pole receptacle being coupled to the bent distal end of the horizontal extension, the pad being coupled to the pole receptacle, the pad being curved, the footrest being configured to support a foot or a leg of a user; and a remote control, the remote control being in wireless communication with the receiver to control the lift mechanism, the remote control adjusting the length of the adjustable support pole and thus a height of the footrest.

* * * * *